US006496173B1

(12) United States Patent
Albu et al.

(10) Patent No.: US 6,496,173 B1
(45) Date of Patent: Dec. 17, 2002

(54) RLCD TRANSCONDUCTANCE SAMPLE AND HOLD COLUMN BUFFER

(75) Inventors: Lucian R. Albu, New York, NY (US); Peter J. Janssen, Scarborough, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/537,824

(22) Filed: Mar. 29, 2000

(51) Int. Cl.[7] ..... G09G 5/10
(52) U.S. Cl. ..... 345/98; 345/147
(58) Field of Search ..... 345/87, 88, 94, 345/98, 100, 63, 77, 89, 147; 342/138; 340/793, 767; 358/241, 236

(56) References Cited

U.S. PATENT DOCUMENTS 4,766,430 A 8/1988 Gillette et al. ..... 340/793
4,996,530 A * 2/1991 Hilton ..... 341/107
5,006,739 A 4/1991 Kimura et al. ..... 307/270
5,442,379 A * 8/1995 Bruce et al. ..... 345/589
6,049,321 A * 4/2000 Sasaki ..... 345/100
6,057,821 A * 5/2000 Hughes et al. ..... 345/100
6,091,390 A * 7/2000 Sim ..... 345/100
6,256,010 B1 * 7/2001 Chen et al. ..... 345/690
6,288,841 B1 * 9/2001 Lee et al. ..... 356/328
6,344,857 B1 * 2/2002 Matono et al. ..... 345/589

* cited by examiner

*Primary Examiner*—Vijay Shankar
*Assistant Examiner*—Nitin Patel

(57) ABSTRACT

A system for generating an image in an RLCD using pulsed current sources instead of pulsed voltage sources to reduce noise and power consumption. The current is provided by a plurality of RAM-driven IDACs having a current output. Each IDAC drives one or more of a plurality of RLCD columns in conjunction with one of a plurality of OTAs.

Time-integration of the applied current by the intrinsic column capacitance of the RLCD creates a controlled voltage ramp on the column capacitance. A Look-Up-Table within each RAM holds a plurality of 8-bit digital values that correspond to the time-derivative of the current values.

2 Claims, 2 Drawing Sheets

RLCD TRANSCONDUCTANCE SAMPLE AND HOLD COLUMN BUFFER

FIELD OF THE INVENTION

This invention pertains to the field of electronic circuits for driving reflective liquid crystal displays (RLCD).

BACKGROUND OF THE INVENTION

In a RLCD having a matrix of m horizontal rows and n vertical columns, each m-n intersection forms a cell or picture element (pixel). By applying an electric potential difference, such as 7.5 volts (v), across a cell, a phase change occurs in the crystalline structure at the cell site causing the pixel to change the incident light polarization vector orientation, thereby blocking the light from emerging from the electro-optical system. Removing the voltage across the pixel causes the liquid crystal in the pixel structure to return to the initial "bright" state. Variations in the applied voltage level produce a plurality of different gray shades between the light and dark limits.

The load that an RLCD presents to a driving circuit is best represented as the sum of the individual pixel capacitances and column line, which can be 12 picofarads (pF) for an individual column of an RLCD having 1024 rows. This load becomes 7.68 nanofarads (IF) for a group of 640 such columns.

At the individual columns, a comparator and a track-and-hold transfer gate are employed to instantaneously terminate the individual column voltage rise when the column capacitance has charged to a predetermined voltage level needed to produce a particular grayscale. As each column terminates at a unique level along the global voltage ramp, a separate pulse-length modulating signal is produced for each individual column.

At the end of a predetermined row time interval, the column voltages are discharged to a fixed reference voltage and the procedure is repeated for the next row. During discharge, a high instantaneous current spike may occur. Assuming all 1024 rows are charged at 7.5 v, a current discharge in approximately 30 nanoseconds (ηs) will generate a peak current of approximately 2 amperes (A). This process is repeated for all the m rows of the LCD to complete a single frame. Repetition of the frame activity allows for the continual updating of the displayed information with refresh rates typically being 60 Hz for video displays. To better appreciate the above process, it would be beneficial to review U.S. Pat. No. 4,766,430 to Gillette et al. which is incorporated herein by reference.

A principal drawback of conventional high current switching circuits of the type just described is that any high speed voltage changes applied to the capacitive load of the RLCD produces very high instantaneous current spikes, i.e., 2 amperes, which in turn produce charge coupling errors within adjacent pixels. In addition, such high current switching devices are not easily configurable within an integrated circuit.

Thus, there is a demonstrated need for an improvement of existing voltage-driven RLCD column driver circuits which would reduce the instantaneous column switching currents and the associated crosstalk interference.

SUMMARY OF THE INVENTION

A system for generating an image in an RLCD from an Integrating Digital-to-Analog Converter (IDAC) that outputs a current pulse rather than a voltage pulse. The IDAC output in series with a plurality of low-current operational transconductance amplifiers (OTAs) is integrated and filtered by the intrinsic capacitance of the RLCD columns thereby reducing noise and power consumption. The IDAC is driven by a Look-Up-Table (LUT) within a Random Access Memory (RAM), which is used to store eight bit time-derivative digital values of the drive currents.

DETAILED DESCRIPTION OF THE DRAWINGS

Figure 1:
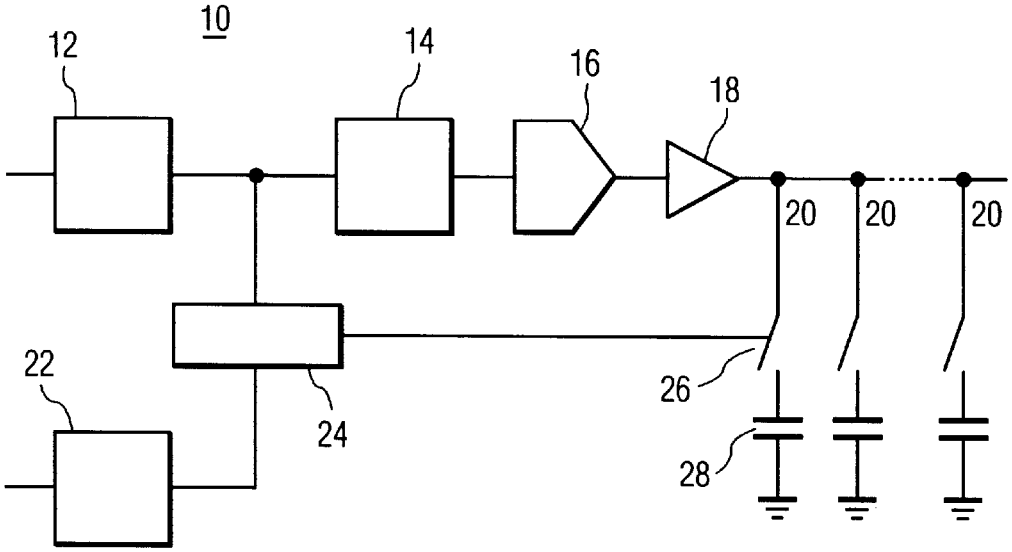
FIG. 1 PRIOR ART
FIG. 1 shows a conventional control circuit for generating an analog excitation voltage.

FIG. 1 shows a conventional control circuit 10 for generating the analog voltage excitation of the prior art. Since the present invention incorporates certain elements of circuit 10, a detailed review of its operation will aid in understanding the teachings of the present invention.

The analog excitation voltage comprises a timed series of small voltage steps that are digitally generated beginning with counter 12 which is triggered by a precision clock which is not shown. The output of counter 12, which has 256 sequential digital values in this example, provides addresses for a LUT in RAM 14 in which are stored a plurality of digital data values representing the predetermined steps of a column excitation voltage waveform. Each digital data value has a resolution of 13 bits, i.e., 8192 possible values. These digital data values are sequentially provided to the input of a digital-to-analog converter (DAC) 16 which transforms them into discrete steps of an analog voltage that is applied to one or more of a plurality of column drivers 18.

This controlled excitation voltage provides the charging source for one or more of a plurality of columns 20 of the RLCD. In this example, 640 columns of the 1024 columns of the representative RLCD are supplied by a single column driver 18.

As the individual column voltage rises, a predetermined digital counter value corresponding to the termination time of that voltage rise is provided for each column by data buffer 22 as one input to digital comparator 24. When the identical output value from counter 12 is present at the other input of comparator 24, comparator 24 will cause the output of a column transfer gate 26 to latch closed, thereby halting the charge current to each column capacitance 28. The pixel is then displayed for the remainder of the frame time interval. Other columns will continue to charge until their unique predetermined values are reached, at which time they will be turned off and the pixels displayed for the remainder of the frame time.

At the end of the charge and display time, a flight back mode is entered, whereby a high current switching device will quickly discharge the column capacitance back to a predetermined reference level within approximately 50 nanoseconds. The currents in this device can approach two amperes during this discharge operation. A representative RLCD device would have a structure of 1280 columns and 1024 rows and have an on-panel integrated pixel switch located between a pixel capacitance and a column, the switch being controlled by a row voltage signal.

Figure 2:
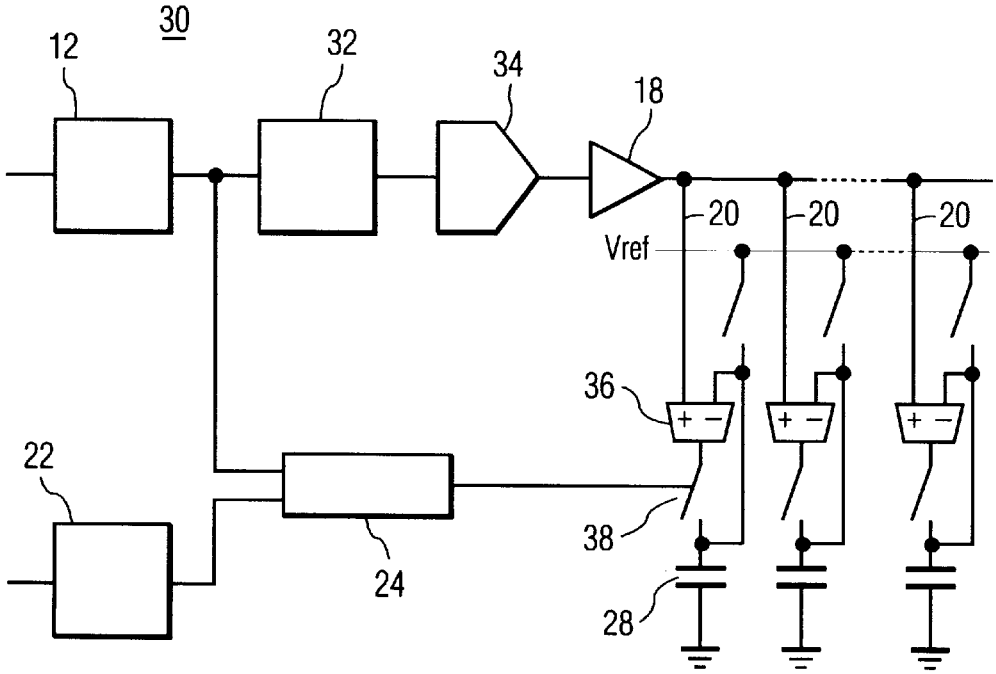
FIG. 2 shows an exemplary embodiment of a control circuit for an analog current excitation path of an RLCD column fabricated according to the present invention.

FIG. 2 shows an exemplary embodiment of a control circuit 30 for an analog current excitation path of a plurality of RLCD columns 20 which is fabricated according to the present invention. Control circuit 30 generates excitation signals required to create an image on a high-resolution display, such as a 1280 row and 1024 column RLCD at 8 bits per color on a silicon die. At a 60 Hz refresh rate, each frame is approximately 5 milliseconds in duration which allows for three colors per frame and provides for a row activity duration of approximately five microseconds.

As in circuit 10, counter 12 is triggered by a precision clock which is not shown. The output of counter 12, which has 256 sequential digital values in this example, provides addresses into a LUT located within a RAM module 32. However, in circuit 30, unlike circuit 10, each one of the plurality of stored digital data values represents the time-derivative of the steps of a column excitation current waveform, with each value having a resolution of at most 8 bits, i.e., 256 possible values. Each one of the plurality of digital data values are sequentially provided to the input of an IDAC 34 which integrates the digital values and presents an analog output current to the input of a plurality of OTAs 36. Each one of the plurality of OTAs 36 is in series with a single column capacitance 28 of the RLCD.

As in circuit 10, when the column capacitance 28 of circuit 30 has charged to a predetermined value, the predetermined counter value in data buffer 22 is reached and each one of the plurality of column comparators 24 will cause the output of each associated one of the plurality of column OTAs 36 to switch to the tri-state or high output impedance state, thereby halting the charge current to that column capacitance 28. The pixels are then displayed for the remainder of the frame time.

Other columns will continue to charge until their unique predetermined values are reached, at which time they will be switched to the tri-state mode. Although this high impedance state is incorporated within the architecture of an OTA 36, it is represented in circuit 30 as an open switch 38 for purposes of clarity. At the end of the charge and display time, a flight back mode is entered whereby an external high current MOS switching device quickly discharges the column capacitance back to a predetermined reference level within approximately 50 nanoseconds.

Since the digital comparator 24 tri-states the output of OTA 36 based on the comparison of an upstream digital signal from the output of counter 12 output rather than the actual voltage on the column capacitance 28, errors can arise at the outputs that need correction. To compensate for such errors, a low current feedback circuit which is not shown compares the actual resultant peak column voltage with a reference voltage for each color and provides an auto-scaling correction signal to control circuit 30 to provide minor adjustment to the column voltages. In addition, at the end of a line period, each column analog voltage value is sampled and stored for calibration use on the next cycle. Each respective value will provide the initial reference voltage for its corresponding column during the following frame.

Control circuit 30 uses small-chip-area circuitry which is more suited for implementation on a high density integrated circuit chip than the larger components used in conventional circuits having a voltage output. Moreover, by limiting the driver circuitry to only low current capability current sources, the noise feed-through to adjacent pixels that is associated with high current spikes is minimized.

Figure 3:
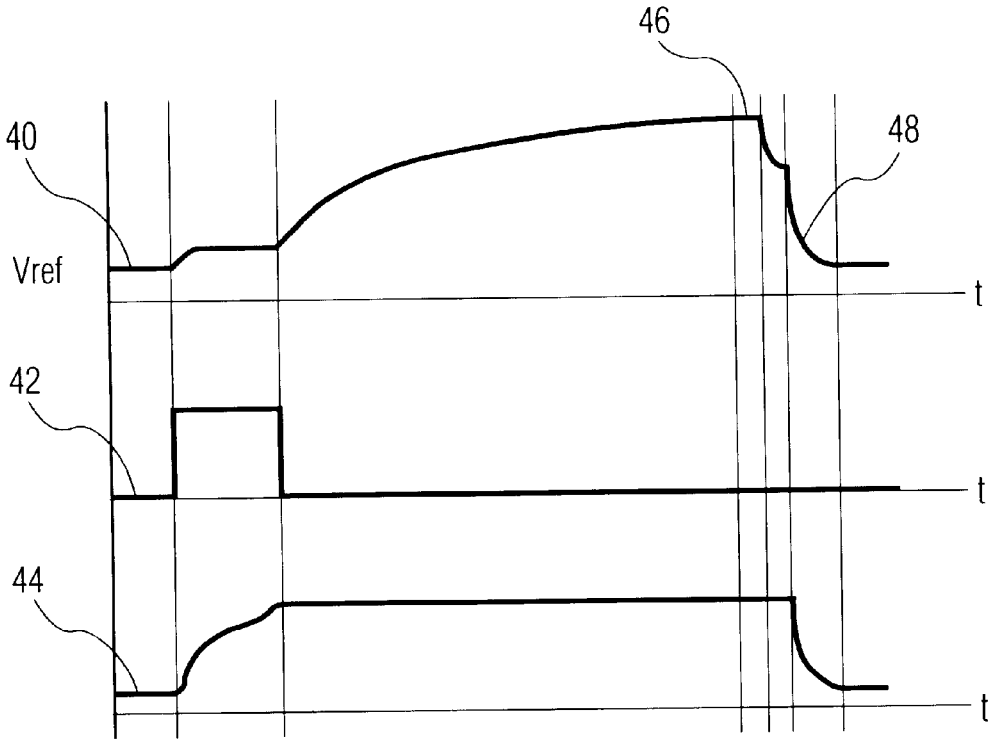
FIG. 3 shows representative waveforms of the voltage applied to the RLCD columns of the present invention.

FIG. 3 shows representative waveforms for the voltage applied to the RLCD columns of circuit 30. The controlled low current provided by OTA 36 of circuit 30 is integrated by panel capacitance 28 to produce a controlled voltage rise in columns 20 and to avoid the generation of the noisy instantaneous current spikes. Waveform 40 represents a typical applied ramp voltage waveform that results from the charge current being applied to column capacitance 28 for the complete row time.

Waveform 42 shows the latching signal applied to the charging OTA 36, and waveform 44 illustrates the resulting envelope of the voltage on the column associated with waveform 42. While waveform 42 is a constant amplitude current pulse, the actual waveform of the charging current applied can be any one of a variety of waveforms and is exclusively controlled by the LUT within RAM module 32. Auto-calibration occurs at location 46 on waveform 42 and column discharge occurs at location 48 on waveform 42.

Numerous modifications to the alternative embodiments of the present invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications which come within the scope of the claims is reserved.

What is claimed is:

1. An image processing system for an RLCD comprising:

a digital data generating means for generating digital values;

a plurality of IDACs providing analog current outputs in response to said digital values, the IDAC current output driving one or more of a plurality of vertical RLCD columns;

an RLCD device comprised of a plurality of vertical columns and a plurality of horizontal rows;

an RLCD column selection means;

an RLCD row selection means;

a discharge means for returning the voltage on each one of a plurality of columns to a reference voltage at the end of a row time; and a calibration means for adjusting color voltage levels, wherein the IDAC output current drives one or more of a plurality of vertical RLCD columns not exceeding 640.

2. An RLCD device, comprising:

a row switch integrated at each different one of a plurality of pixel locations;

a matrix structure comprised of a plurality of vertical columns and a plurality of horizontal rows;

a column selection means for beginning and ending current flow to each different one of a plurality of columns in response to a logical input signal; and a row selection means, wherein the row selection means comprises a digital input signal applied to the row switch.

* * * * *